US007004129B2

(12) United States Patent
Schneider

(10) Patent No.: US 7,004,129 B2
(45) Date of Patent: Feb. 28, 2006

(54) CAMSHAFT ADJUSTING DEVICE FOR VEHICLES, ESPECIALLY MOTOR VEHICLES

(75) Inventor: Guido Schneider, Altenstadt (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 0 days.

(21) Appl. No.: 10/904,164

(22) Filed: Oct. 27, 2004

(65) Prior Publication Data

US 2005/0115526 A1 Jun. 2, 2005

(30) Foreign Application Priority Data

Oct. 28, 2003 (DE) ..... 103 51 223

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 4,841,924 A | | 6/1989 | Hampton et al. | 123/90.15 |
| 5,870,983 A | * | 2/1999 | Sato et al. | 123/90.17 |
| 6,155,219 A | | 12/2000 | Fukuhara et al. | 123/90.17 |

* cited by examiner

*Primary Examiner*—Thomas Denion
*Assistant Examiner*—Zelalem Eshete
(74) *Attorney, Agent, or Firm*—Gudrun E. Huckett

(57) ABSTRACT

A camshaft adjusting device for a motor vehicle has a stator and a rotor adjustable relative to the stator in a circumferential direction by a pressure medium. A restoring spring is arranged in a spring chamber and is configured to rotate the stator and the rotor relative to one another into an initial position when an engine of the motor vehicle is turned off. The restoring spring has a rotor end positive-lockingly connected to the rotor and a stator end positive-lockingly connected to the stator. One of the rotor end and the stator end is provided with a convexly curved embossment that cooperates with a convexly curved outer side of a positive-locking counter element on the rotor or stator, respectively. The embossment is provided at a radially outer end of the restoring spring. The restoring spring is a flat spiral spring.

14 Claims, 2 Drawing Sheets

CAMSHAFT ADJUSTING DEVICE FOR VEHICLES, ESPECIALLY MOTOR VEHICLES

BACKGROUND OF THE INVENTION

The present invention relates to a camshaft adjusting device for vehicles, especially motor vehicles. The device comprises a stator and a rotor that is adjustable relative to the stator by means of a pressure medium as well as a restoring spring that is arranged in a spring chamber and is provided for rotating the stator and the rotor relative to one another into an initial position when the motor is turned off, wherein the ends of the restoring spring correlated with the rotor and the stator are secured positive-lockingly, respectively.

Camshaft adjusting devices in motor vehicles (compare U.S. Pat. Nos. 4,841,924; 6,155,219) serve for changing by a relative rotation between the stator and the rotor the angular position between the camshaft and the crankshaft in order to adjust in this way the duration of valve opening of the motor to the current power demand. When the motor is turned off, it is necessary for starting the engine again that the stator and the rotor have a predetermined initial position relative to one another. For this purpose, a restoring spring is provided that ensures that these two parts are rotated back into the initial position. The ends of the restoring spring are fastened positive-lockingly at the rotor and the stator, respectively. The radial outer end of the restoring spring is hook-shaped and is hooked in a bolt or the stay. In operation of the camshaft adjusting device, movements of this spring occur that, as a result of the fixed connection with the bolt or the stay, can lead to significant wear. This entails the risk that the restoring spring will fail or that it can no longer precisely adjust the initial position of stator and rotor relative to one another.

SUMMARY OF THE INVENTION

It is an object of the present invention to configure the camshaft adjusting device of the aforementioned kind such that by means of the restoring spring the initial position of the stator and rotor relative to one another can be reliably reached.

In accordance with the present invention, this object is solved for the camshaft adjusting device of the aforementioned kind in that one spring end has a convexly curved embossment that cooperates with a convexly curved outer side of a positive-locking counter element.

The convexly curved embossment at one spring end provides such a positive locking engagement of the convexly curved outer side of the positive-locking counter element that the spring end can perform a minimal relative movement relative to the positive-locking counter element without this causing undesirable tension or stress within the restoring spring. The embossment enables a play-free connection of the restoring spring. Any type of movement of the spring end is compensated without wear by the embossment.

Advantageously, the spring end with the embossment is supported in the radial direction by at least one support member that is provided near the embossment. The support member prevents an undesirable bending moment of the spring end from occurring. Moreover, the support member ensures that the restoring spring in the area of its spring end is properly supported so that bending moments between the embossment and the adjoining curved area of the spring winding are avoided.

DESCRIPTION OF PREFERRED EMBODIMENTS

Figure 3:
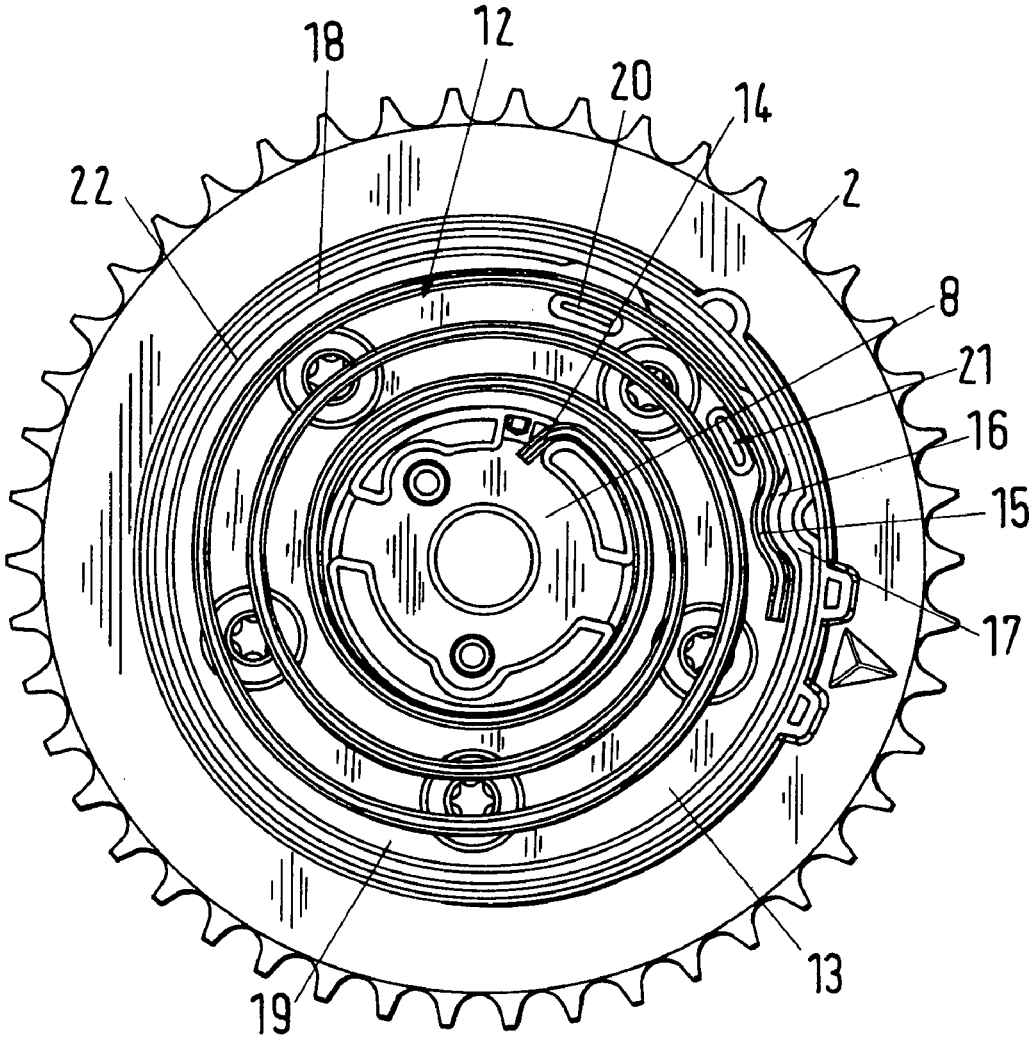
FIG. 3 shows a plan view onto the part of the camshaft adjusting device according to FIG. 1 that comprises the flat spiral spring.

During operation of an internal combustion engine, the angular position between the crankshaft and the camshaft is changed by means of the camshaft adjusting device. By rotation of the camshaft, the duration of opening and closing of the gas exchange valves is changed such that the internal combustion engine provides optimal power output at any engine speed. The camshaft adjusting device is configured according to the oscillating motor principle and enables a continuous adjustment of the camshaft relative to the crankshaft. The camshaft adjusting device has a cylindrical stator 1 that is connected fixedly to the drive wheel 2 (FIG. 3). In the illustrated embodiment, the drive wheel is a pulley about which the drive belt is guided. The drive wheel 2 can also be a chain wheel about which a chain as a drive element is guided. By means of this drive element and the drive wheel 2 the stator 1 is drivingly connected to the crankshaft as is known in the art.

The stator 1 and the drive wheel 2 can be formed together as a monolithic part and can be comprised of a metal material or of hard plastic material. The stator 1 has a cylindrical base member 3 having at its inner side radial inwardly extending vanes 4 that are uniformly spaced relative to one another. Between neighboring vanes 4 pressure chambers 5 are formed into which, controlled by valves, pressure medium can be introduced. Vanes 6 project into the space between neighboring stator vanes 4 and extend radially outwardly away from the cylindrical base member 7 of the rotor 8. The rotor vanes 6 divide the pressure chambers 5 between the stator vanes 4 into two pressure chambers 9 and 10, respectively.

The stator vanes 4 rest with their end faces sealingly against the outer wall surface of the base member 7 of the rotor 8. The rotor vanes 6, in turn, rest with end faces sealingly against the cylindrical inner wall of the base member 3 of the stator 1.

The rotor 8 is fixedly secured on the camshaft (not illustrated). In order to change the angular position between the camshaft and the crankshaft, the rotor 8 is rotated relative to the stator 1. For this purpose, depending on the desired rotational direction, the pressure medium is pressurized in the pressure chambers 9 or 10 while the other pressure chambers are relieved to the tank, respectively.

Figure 1:
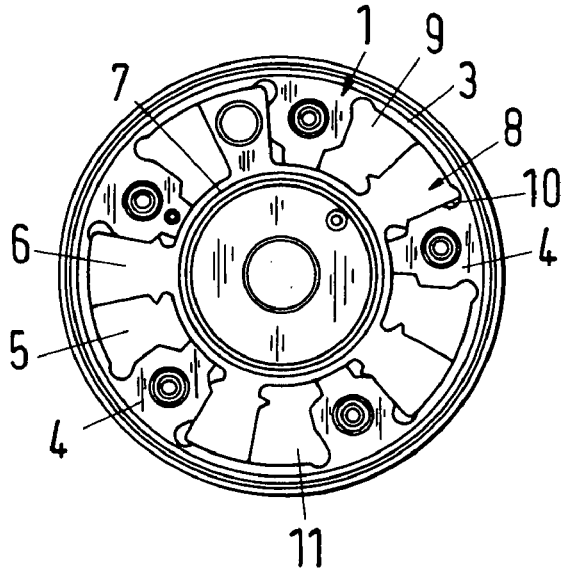
FIG. 1 shows in a schematic illustration a camshaft adjusting device according to the present intention.
Figure 2:
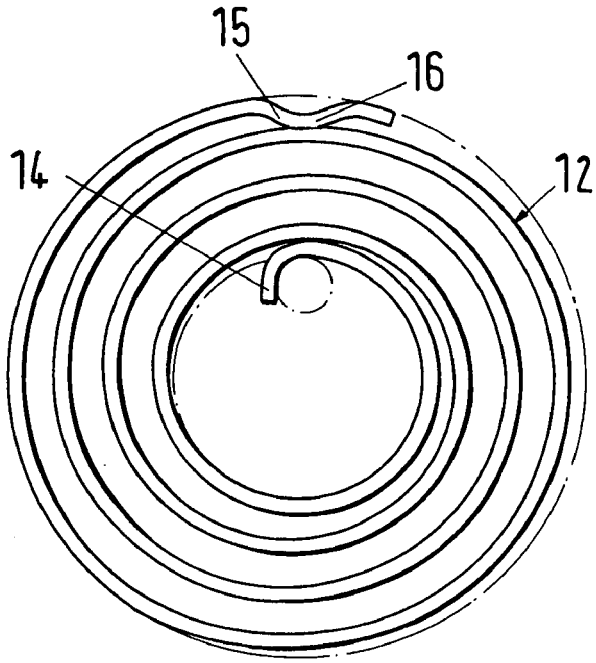
FIG. 2 shows in a detail illustration a flat spiral spring of the camshaft adjusting device according to FIG. 1.

The rotor and the stator are axially secured by two cover plates of which only one cover plate 11 is shown in FIG. 1. The two cover plates delimit moreover the pressure chambers 5 between the stator vanes 4 in the axial direction. In order for the rotor 8 to assume the early camshaft position for the exhaust valve required for starting the engine, the rotor 8 is rotated by at least one restoring spring 12 (FIGS. 2 and 3) into its initial position. In this initial position, locking of the rotor and the stator relative to one another is realized, for example, by a spring-loaded piston. The piston can be arranged in one of the rotor vanes 6 that, upon pressure loss in the camshaft adjusting device, can be moved by a spring force into a locking position in which it engages a locking opening of the stator 1. When starting the engine, the locking bolt is loaded by the pressure medium against the spring force and is returned so that the rotor 8 and the stator 1 are released from one another and the camshaft adjusting device can reach its control position.

The restoring spring 12 is located in a spring chamber 13 that is arranged between one of the cover plates and a lid that is fixedly connected to the stator 1 or the cover plate 11. The restoring spring 12 is configured as a flat spiral spring which is connected with one end 14 (rotor end) fixedly to the rotor 8. The other spring end 15 (stator end) is secured to the stator 1. The spring end 15 is provided with an embossment 16 that is convexly curved and rests against a counter element 17 having a shaped portion of a matching shape. This matching counter element 17 is provided on the cylindrical wall of the spring chamber 13. The wall 18 is fixedly connected to the stator 1 or the drive wheel 2. The embossment 16 is positioned at a spacing from the free end of the flat spiral spring 12. In the initial position illustrated in FIG. 3, this convex embossment 16 rests areally against the convex counter element 17. This embossment 16 at the radial outer spring end 15 provides positive locking engagement between the counter element 17 and the restoring spring 12. Any type of movement of the spring end 15 is compensated by the embossment 16 without causing wear. As a result of the convexly curved configuration, the free spring end 15 can perform a minimal relative movement relative to the counter element 17 or the wall 18. When this occurs, no undesirable tension or stress is caused in the restoring spring 12.

At a spacing from the counter element 17, two projections 20 and 21 project from the bottom 19 of the spring chamber 13; the projections are spaced from one another and from the counter element 17 in the circumferential direction. They are positioned at a spacing to the wall 18, and the outer winding 22 of the restoring spring 12 rests against the projections at a small spacing from the spring end 15. The two projections 20, 21 form an additional support for the restoring spring 12 and prevent an undesirable bending moment when loading the restoring spring 12. Advantageously, the projections 20, 21 in the circumferential direction are of an elongate configuration and match the contour or the radius of the spring winding 22 so that the restoring spring 12 can rest properly against the projections 20, 21. In this way, bending moments in the area between the embossment 16 and the adjoining area of the spring winding 22 are prevented.

The radial spacing of the projections 20, 21 from the wall 18 is greater than the thickness of the spring winding 22 so that the spring winding 22 has a spacing from the wall 18. The projection 21 is moreover located at such a spacing from the counter element 17 of the wall 18 that the spring end 15, despite the convex configuration of the embossment 16, engages positive-lockingly the counter element 17.

The counter element 17 ensures the connection to the spring and extends only across a small angular area. The projections 20, 21 are arranged in an angular area of less than 90 degrees. The embossment 16 is also located within this angular area. The counter element 17 is advantageously designed such that with its part that projects radially the farthest inwardly it has a greater spacing from the wall 18 than the neighboring projection 21. This has the result that the spring end 15 is clamped in the area between the projection 21 and the counter element 17. Moreover, the counter element 17 provides that the outer winding 22 has a spacing from the wall 18 so that friction between the outer spring winding 22 and the wall 18 is prevented. This displacement of the spring end 15 in the direction toward the axis of the camshaft adjusting device prevents also contacting of the spring windings so that the moment of friction of the restoring spring 12 is reduced.

The contact side of the projections 20, 21 is advantageously matched to the spring contour such that the restoring spring 12 rests optimally against the projections 20, 21. In this way, the generation of a bending moment between the counter element 17 and the projections 20, 21 is prevented.

The described connection of the spring end 15 and the wall 18 has the advantage that the maximum available wire length of the restoring spring 12 can be employed. The service life of the restoring spring 12 is increased. Moreover, the spring moment can be designed to be uniform across the adjusting range. Finally, the efficiency of the restoring spring 12 is increased.

As a result of the described configuration, there are also advantages for the manufacture of the restoring spring 12. Material can be saved because of the embossment 16 provided on the spring end 15. In conventional restoring springs where this end is angled at a right angle, more material is required for manufacturing the restoring spring.

Mounting of the restoring spring 12 is possible without problems because the spring end 15, due to the embossment 16, must not be mounted with high precision.

The connection of the restoring spring 12 to the stator 1 cannot only be realized by means of the counter element 17 of the wall 18 but also, for example, by employing pins, bolts and the like which can be mounted so as to be upright on the bottom 19 of the spring chamber 13. The pins, bolts and the like have also a convexly curved outer side so that in the same way as disclosed in connection with FIG. 3 the spring end 15 can be connected with its embossment 16 to these pins, bolts and the like.

While specific embodiments of the invention have been shown and described in detail to illustrate the inventive principles, it will be understood that the invention may be embodied otherwise without departing from such principles.

What is claimed is:

1. A camshaft adjusting device for a motor vehicle, comprising:

a stator and a rotor adjustable relative to the stator in a circumferential direction by a pressure medium;

a spring chamber;

a restoring spring arranged in the spring chamber, wherein the restoring spring is configured to rotate the stator and the rotor relative to one another into an initial position when an engine of the motor vehicle is tumed off;

wherein the restoring spring has a rotor end positive-lockingly connected to the rotor and a stator end positive-lockingly connected to the stator;

wherein a first one of the rotor end and the stator end is provided with a convexly curved embossment that cooperates with a convexly curved outer side of a positive-locking counter element provided on the rotor or stator, respectively;

wherein the positive-locking counter element is provided on the stator.

2. The device according to claim 1, wherein the embossment is provided at a radially outer end of the restoring spring.

3. The device according to clean 1, wherein the restoring spring is a flat spiral spring.

4. The device according to claim 1, wherein the positive-locking counter element is provided on a wall of the spring chamber.

5. A camshaft adjusting device for a motor vehicle, comprising:

a stator and a rotor adjustable relative to the stator in a circumferential direction by a pressure medium;

a spring chamber having a cylindrical wall;

a restoring spring arranged in the spring chamber, wherein the restoring spring is configured to rotate the stator and the rotor relative to one another into an initial position when an engine of the motor vehicle is turned off;

wherein the restoring spring has a rotor end positive-lockingly connected to the rotor and a stator end positive-lockingly connected to the stator;

wherein a first one of the rotor end and the stator end is provided with a convexly curved embossment that cooperates with a convexly curved outerside of a positive-locking counter element provided on the rotor or stator, respectively;

wherein the positive-locking counter element is a radially projecting shaped portion of the cylindrical wall of the spring chamber.

6. The device according to claim 5, wherein the positive-locking counter element is provided on the stator.

7. The device according to claim 5, wherein the shaped portion is convexly curved.

8. A camshaft adjusting device for a motor vehicle, comprising:

a stator and a rotor adjustable relative to the stator in a circumferential direction by a pressure medium;

a spring chamber;

a restoring spring arranged in the spring chamber, wherein the restoring spring is configured to rotate the stator and the rotor relative to one another into an initial position when an engine of the motor vehicle is turned off;

wherein the restoring spring has a rotor end positive-lockingly connected to the rotor and a stator end positive-lockingly connected to the stator;

wherein a first one of the rotor end and the stator end is provided with a convexly curved embossment that cooperates with a convexly curved outer side of a positive-locking counter element provided on the rotor or stator, respectively;

at least one support member configured to radially support the first one of the rotor end and the stator end at a location adjacent to the embossment.

9. The device according to claim 8, wherein the at least one support member is a projection provided on a bottom of the spring chamber.

10. The device according to claim 8, wherein the restoring spring rests areally against an outer side of the at least one support member.

11. The device according to claim 8, wherein two of the at least one support members are provided and wherein the two support members are spaced apart from one another in the circumferential direction.

12. The device according to claim 11, wherein the two support members are identical.

13. The device according to claim 11, wherein the two support members are arranged within an angular area of less than 90 degrees.

14. The device according to claim 11, wherein the two support members and the embossment are arranged in an angular area of less than 90 degrees.

* * * * *